United States Patent [19]

Mayland

[11] Patent Number: 4,973,022

[45] Date of Patent: Nov. 27, 1990

[54] WHEELCHAIR SECUREMENT APPARATUS

[75] Inventor: Thomas Mayland, Morton, Ill.

[73] Assignee: Action Concepts, Inc., Morton, Ill.

[21] Appl. No.: 367,352

[22] Filed: Jun. 16, 1989

[51] Int. Cl.[5] ..... A47B 97/00

[52] U.S. Cl. ..... 248/503.1; 296/65.1

[58] Field of Search ..... 248/503.1, 503, 500; 280/289 WC, 242 WC, 179 R; 180/326; 296/65.1, 63; 410/4, 7, 23, 57, 9, 3; 297/DIG. 4

[56] References Cited

U.S. PATENT DOCUMENTS

| | | | |
|---|---|---|---|
| 1,693,184 | 11/1928 | Rumely | 410/9 |
| 1,753,838 | 4/1930 | Seeley | 410/9 |
| 3,955,847 | 5/1976 | Schiowitz | 410/19 X |
| 4,060,271 | 11/1977 | Williams . | |
| 4,076,268 | 2/1978 | Hart . | |
| 4,083,594 | 4/1978 | Tullock | 410/9 X |
| 4,093,303 | 6/1978 | Nelson | 410/9 X |
| 4,227,633 | 10/1980 | Sellberg | 410/19 X |
| 4,257,644 | 3/1981 | Stephens . | |
| 4,265,478 | 5/1981 | Korsgaard . | |
| 4,266,822 | 5/1981 | Barecki et al. . | |
| 4,325,576 | 4/1982 | Guthrie . | |
| 4,389,056 | 6/1983 | Tenniswood . | |
| 4,457,551 | 7/1984 | Anthony . | |
| 4,475,762 | 10/1984 | DeLong . | |
| 4,511,171 | 4/1985 | Petersen . | |
| 4,730,964 | 3/1988 | Joyner | 296/65.1 X |
| 4,754,946 | 7/1988 | Constantin . | |

*Primary Examiner*—J. Franklin Foss

*Attorney, Agent, or Firm*—McCaleb, Lucas & Brugman

[57] ABSTRACT

Apparatus for securing a wheelchair to the floor of a vehicle or the like comprises two pairs of clamp posts journaled for up and down movement. Each post has a pair of clamp jaw members positioned to engage the wheelchair underframe. A main piston raises and lowers the posts simultaneously. Each post has a pair of clamp jaw pistons operatively connected to the corresponding clamp jaw members to grip the underframe. A control circuit comprises an electrical-motor-operated pump, a four-way solenoid-operated direction control spool valve, a pair of sequence valves, pilot operated check valves in the pressure lines leading to the clamp jaw pistons, and a three-way electrical toggle switch having "UP", "DOWN" and "OFF" modes. In "UP" mode the main piston lifts the clamp posts to and optionally beyond a position to engage the frame where one of the sequence valves directs pressure fluid to the clamp jaw pistons to lock the clamp jaws onto the frame. Locking pressure is held by the pilot-operated check valves even during "OFF" mode. In "DOWN" mode, the other sequence valve actuates the pilot-operated check valves to release pressure from the clamp jaw pistons to open the clamp jaws, and to lower the clamp posts to stowed positions beneath the frame.

28 Claims, 9 Drawing Sheets

WHEELCHAIR SECUREMENT APPARATUS

FIELD OF THE INVENTION

The present invention relates to apparatus for securing the frame of a wheelchair to the floor of a vehicle and more specifically to such apparatus which is poweroperated and can be locked and released in a few seconds without any special modification of the frame.

BACKGROUND OF THE INVENTION

There is an increased awareness and concern for the safety of wheelchair occupants being transported in vehicles While providing impact protection for able-bodied people in public and private vehicles is a difficult engineering problem, it is a far more difficult and complex engineering problem to provide handicapped, wheelchair-bound individuals with the same degree of crashworthiness protection.

The conventional wheelchair is not made with crashworthiness in mind. The light weight bicycle-type wheels are likely to collapse under the high G deceleration forces encountered in collisions at moderate speeds or even in panic braking to avoid such collisions.

Many wheelchair restraint systems are difficult or impossible for a wheelchair occupant to use. Even with help, it may take several minutes to tie down a single wheelchair. This can cause substantial delays when a whole busload of wheelchairs and their occupants are being secured at the beginning of a trip and released at the end of the trip.

Some of the prior art securement systems utilize removable pins engagable with the main wheels. For example, one such device is disclosed in De Long et al. U.S. Pat. No. 4,475,762 entitled "WHEELCHAIR RESTRAINT SYSTEM". As pointed out the weak links in this design are the light weight spoked bicycle wheels which are prone to collapse under high-G forces.

Other securement systems which have been employed since the turn of the century use cables, chains or the like to tie the frame to the floor. Examples are disclosed in Williams U.S. Pat. No. 4,060,271 issued Nov. 29, 1977 on "WHEELCHAIR HOLD DOWN ASSEMBLY" and Stephens U.S. Pat. No. 4,257,644 issued May 24, 1981 on "WHEELCHAIR TIE-DOWN". Many wheelchair occupants find it difficult and time-consuming at best and impossible at worst to tighten a number of chains to the floor. Further, the tension in the chains is reacted by extra loadings on the wheels which can exacerbate their tendency to collapse under crash conditions.

Many conventional systems beef up the frame with special components and extra frame sections with loops or pins engaging counterparts on the floor. The problem with this is that it in effect requires rebuilding of the wheelchair frame. Examples are Constantin U.S. Pat. No. 4,754,946 issued July 5, 1988 on "WHEELCHAIR RESTRAINING DEVICE", Anthony U.S. Pat. No. 4,457,551 issued July 3, 1984 on "VEHICLE SPEED-LOCK WHEELCHAIR RESTRAINT SYSTEM", Peterson U.S. Pat. No. 4,511,171 issued Apr. 16, 1985 on "WHEELCHAIR RESTRAINT", Hart U.S. Pat. No. 4,076,268 issued Feb. 28, 1978 on "SECURING MEANS", and Tenniswood U.S. Pat. No. 4,389,056 issued June 21, 1983 on "WHEELCHAIR".

SUMMARY OF THE INVENTION

It is a general object of the present invention to provide apparatus for securing a wheelchair to the floor of a vehicle to protect the occupant from injury and minimize damage to the wheelchair during emergency braking or rapid acceleration.

Another object is to provide such securement apparatus which is power operated, and a wheelchair can be secured to or released from it in a matter of seconds instead of several minutes as is the case with some prior art securement systems using tie-down cables, chains or ropes.

Another object is to provide a fully automatic apparatus which may be locked or released by a control switch or button operated at each wheelchair location or by a single master switch or button near the vehicle driver or attendant.

Another object is to provide such an apparatus which clamps onto the strongest part of the wheelchair namely the frame which is far more capable of absorbing high-G acceleration and deceleration forces than the wheels.

Another object is to provide such an apparatus which lifts the frame and holds it in elevated condition with the wheels disengaged from the floor.

BRIEF DESCRIPTION OF THE DRAWINGS

Other objects and advantages will be apparent from the following description taken in connection with the drawings in which.

Like parts are referred to by like reference characters throughout the figures of the drawings.

DETAILED DESCRIPTION OF THE PREFERRED EMBODIMENT

Figure 2:
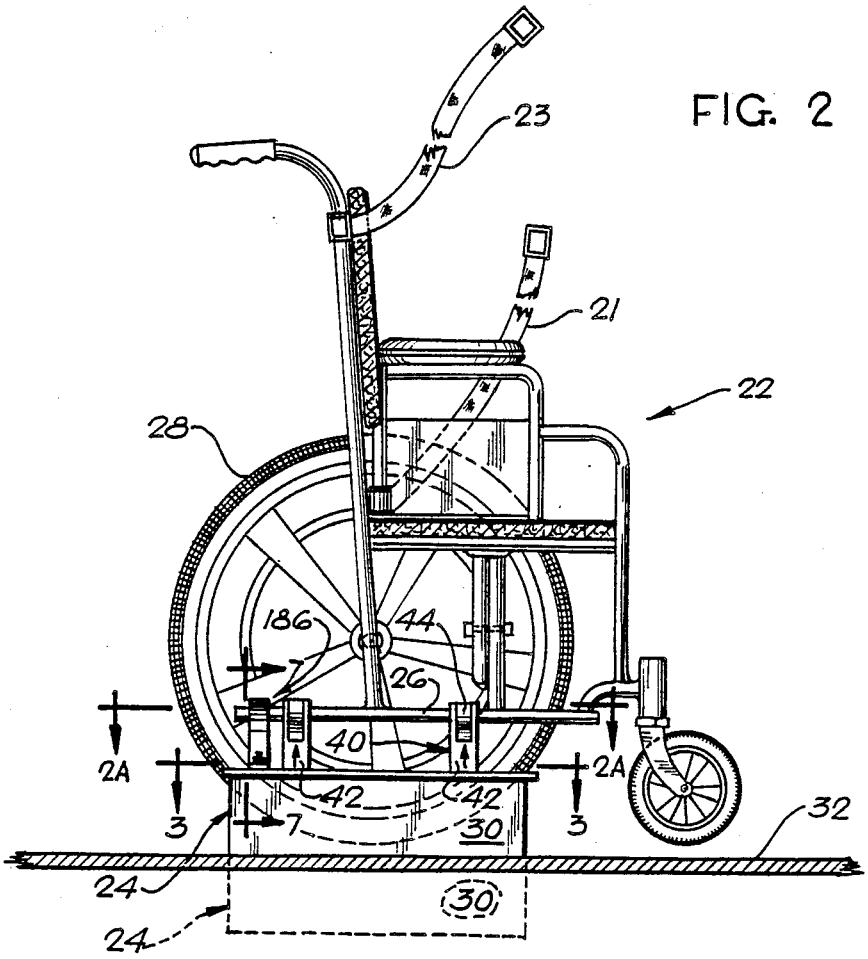
FIG. 2 is an enlargement of a wheelchair partly sectioned for clarity showing one of the wheelchairs secured in the vehicle.
Figure 1:
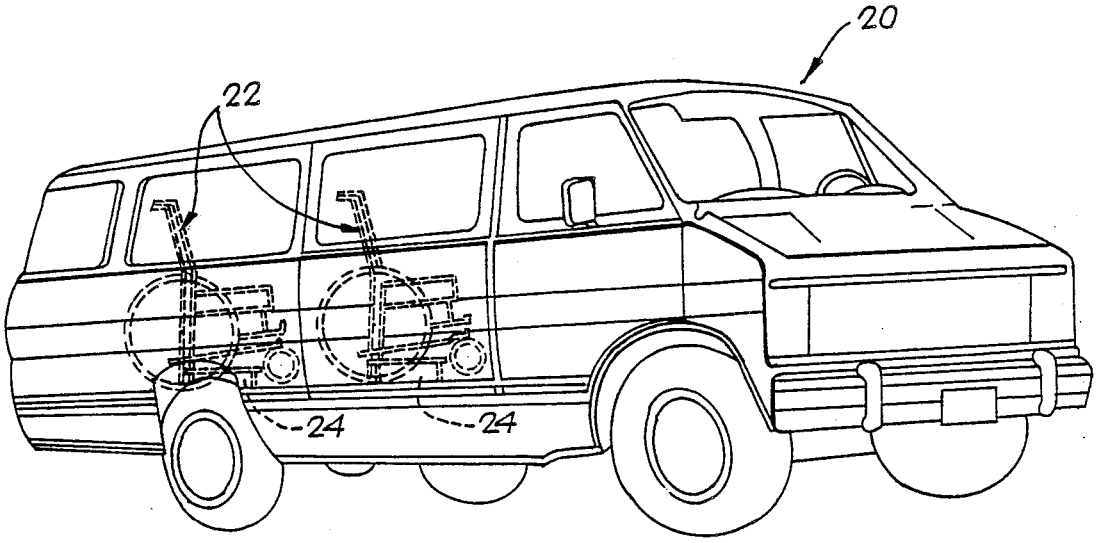
FIG. 1 is a side view of a vehicle showing a number of wheelchairs secured to the floor thereof with the apparatus of the present invention.

Referring now to the embodiment illustrated in the drawings, a vehicle 20 is fitted to transport a plurality of wheelchairs 22 with their occupants.

Figure 2A:
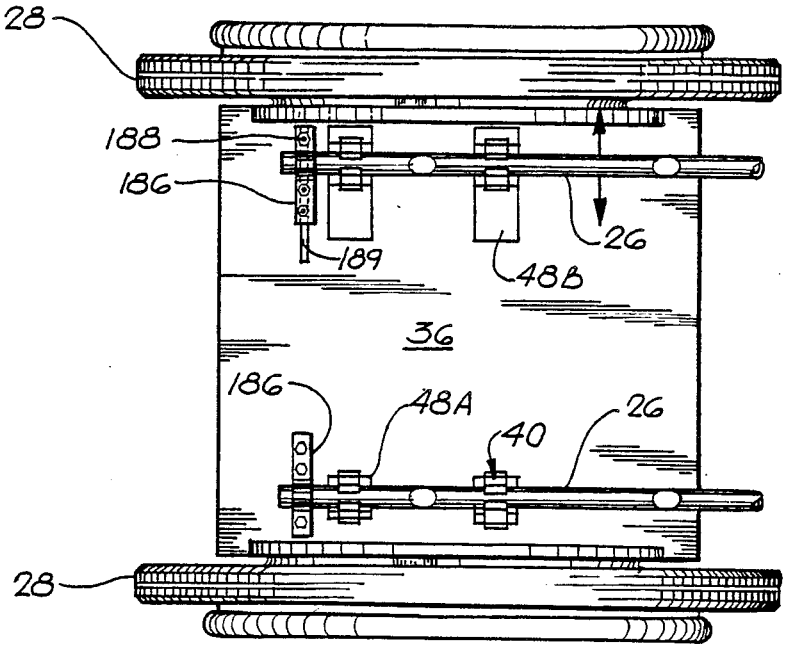
FIG. 2A is a fragmentary cross-sectional view of FIG. 2 taken along line 2A—2A.

As best shown in FIG. 2, each wheelchair is positioned over securement apparatus of the present invention generally designated 24. While wheelchair construction varies from one manufacturer to another, a feature common to a majority of them is an underframe with a pair of transversely spaced, longitudinally extending, parallel, horizontal frame tubes 26. These are located at the sides of the frame just inside the wheels 28 (FIGS. 2 and 2A). The transverse spacing between the frame tubes 26 may vary in different models. The securement apparatus of the present invention clamps to underframe tubes 26 and is transversely adjustable to accommodate such different spacings.

The wheelchair may be fitted with seat and shoulder belts 21 and 23 as shown in FIG. 2.

The wheelchair securement apparatus 24 comprises a housing 30 which may be secured in any suitable manner as by bolting or welding to the floor 32 of the vehicle. Preferably it will be recessed in an opening 31 in the floor to maximize clearance relative to the underframe of the wheelchair as shown in FIGS. 4 and 5. Optional above- and below-the-floor positions are shown in solid- and broken-line positions in FIG. 2. The housing is generally square in plan view (FIGS. 2A and 3) with an external flange 34 and a cover plate held in place by bolts 38.

A plurality (in this case four) of clamp means generally designated 40 is journaled for up and down movement in the housing. Each clamp means 40 comprises a square clamp post 42 each having a pair of pivotal clamp jaws 44, 44 for gripping the frame tube members 26.

Figure 4:
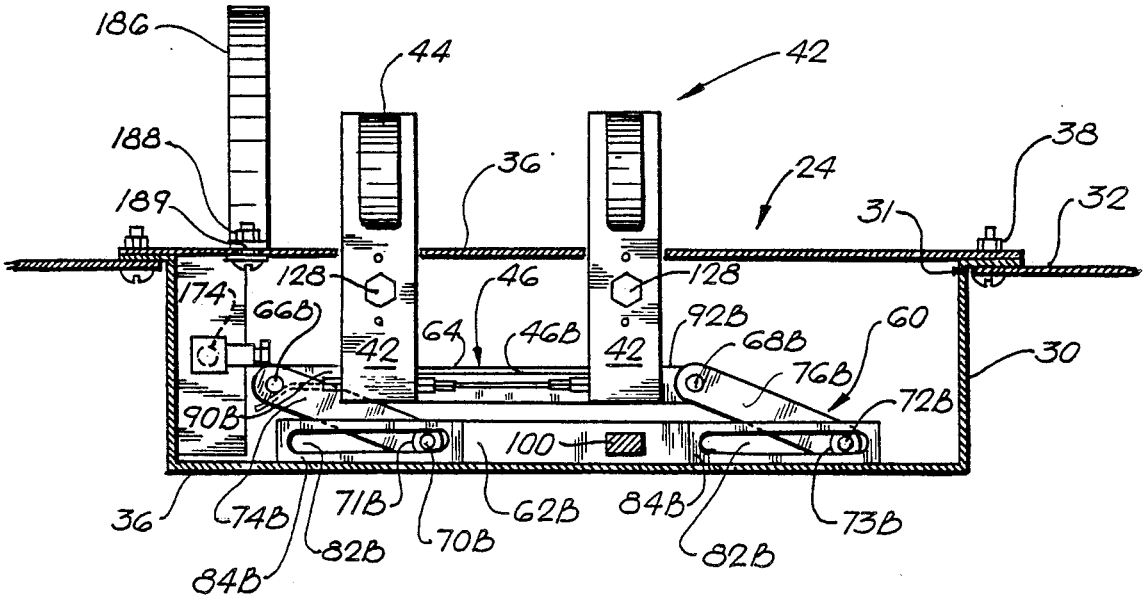
FIG. 4 is a vertical cross-sectional view of FIG. 3 taken along line 4—4, showing the apparatus in lowered or stowed position.
Figure 5:
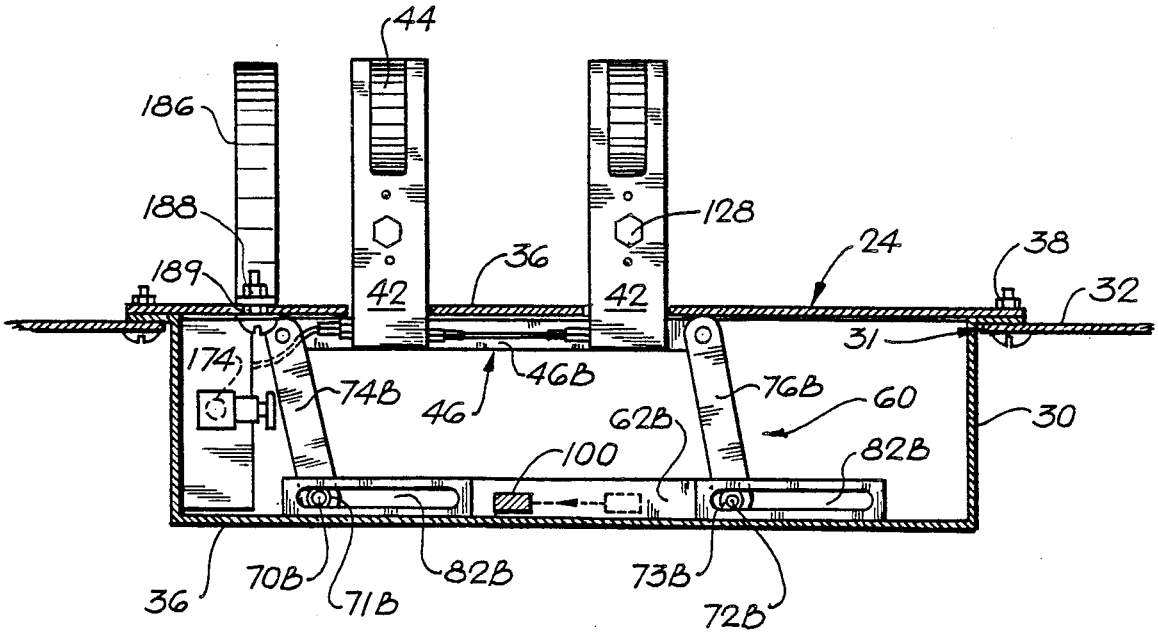
FIG. 5 is a view similar to FIG. 4 showing the apparatus in fully elevated position.
Figure 6:
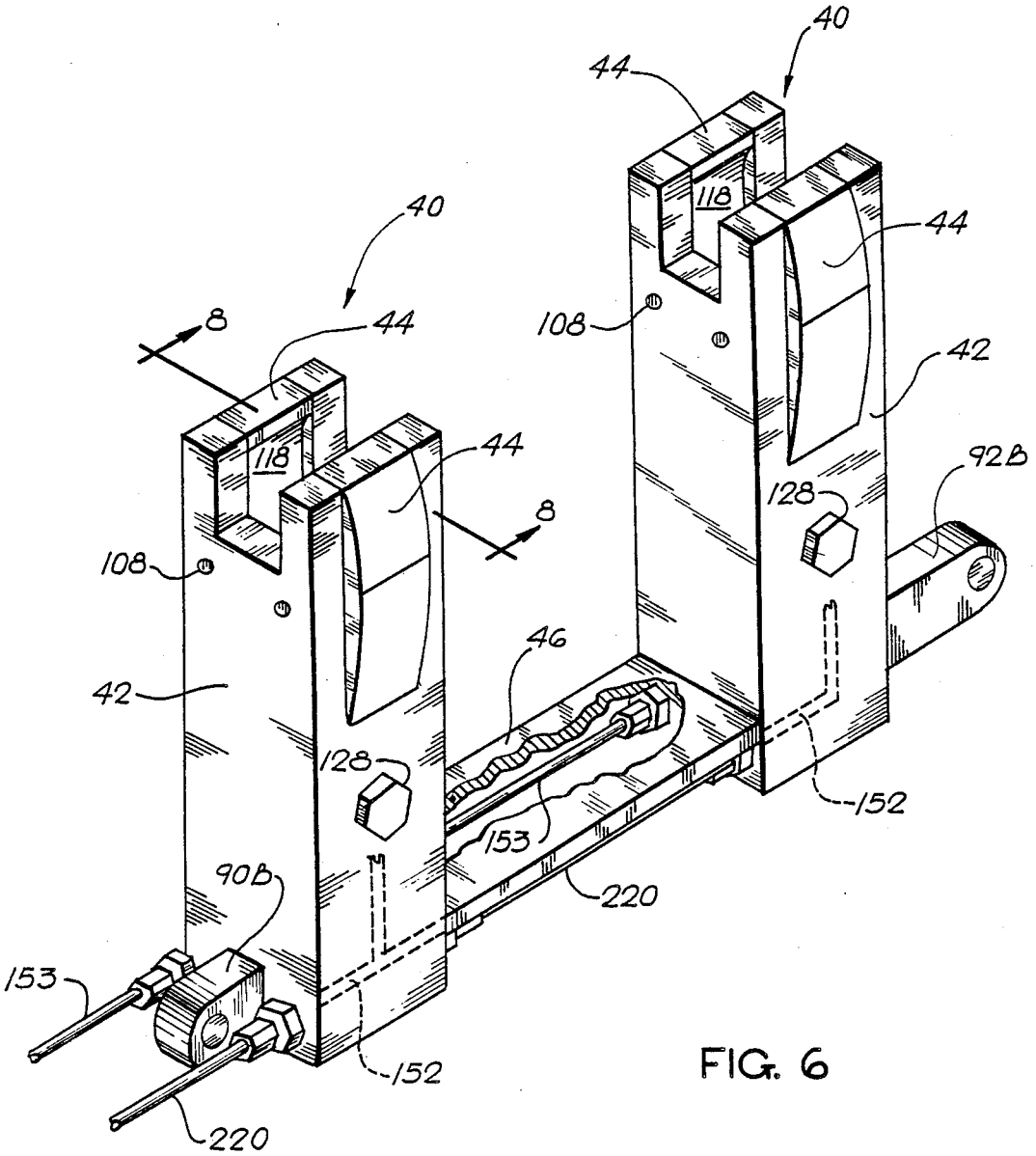
FIG. 6 is a fragmentary perspective view of either FIG. 4 or 5.

The clamp posts are arranged in pairs, one pair on each side of the housing being tied together along the bottom by a horizontal T-bar 46 (FIGS. 4,5 and 6). The right hand pair of clamp posts 42 extend through respective square openings 48*a* in the cover plate. See FIG. 2A, and FIG. 3 where these are shown in phantom. The left hand pair of clamp posts 42 extend through openings 48B,48B which are elongated into rectangular shapes as shown in FIG. 2A, and in phantom in FIG. 3, to enable transverse adjustability of the clamp means to accommodate different spacings between the underframe tubes 26.

First power means comprising a main cylinder and piston means 50 raises and lowers the clamp means 40 through a vertically expandable parallelogram linkage generally designated 60. The main cylinder and piston means 50 comprises a horizontal cylinder 54, main piston 56 and piston rod 58.

The vertically expandable parallelogram linkage 60 shown in the diagrammatic side views of FIGS. 9–14 comprises substantially identical right- and left-hand sections 60A and 60B, the latter being modified slightly to enable transverse adjustability to accommodate different spacing between under frame tubes 26.

Referring first to the diagrammatic side views shown in FIGS. 9–14, the parallelogram linkage 60 comprises a 4-bar parallelogram linkage consisting of lower and upper same-length horizontal bar means 62 and 64 which are pivotally connected at 66, 68, 70 and 72 with same-length connecting link means 74,76. The clamp posts 42 on the upper bar means 64 are vertically moveable in response to horizontal shifting movement of the lower bar means 62 by piston rod 58.

The parallelogram linkage which is generally designated 60 in the diagrammatic views of FIGS. 9–14 actually consists of separate right and left hand parallelogram linkages 60A and 60B (FIG. 3) which are basically the same except that 60B is somewhat wider to enable the transverse adjustability referred to above for accommodating different spacings between frame tubes 26.

Figure 3:
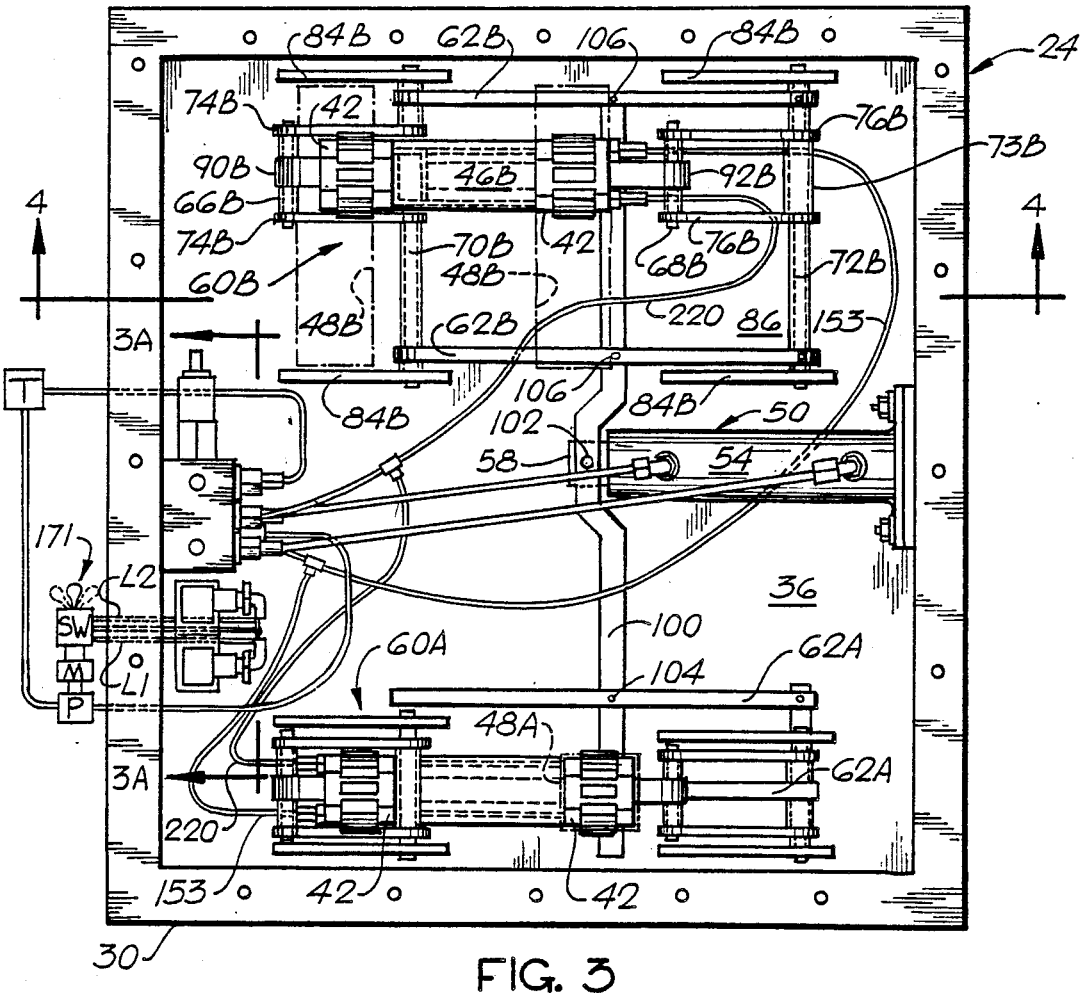
FIG. 3 is a plan view of the securement apparatus, in the direction of arrows 3—3 in FIG. 2, with the cover plate removed to show the major internal components.

The specific components of the left hand parallelogram linkage 60B as shown in FIGS. 3, 4 and 5 will now be described. The lower bar means (corresponding to that designated 62 in FIG. 9) comprises a pair of transversely spaced horizontal lower slide bars 62B interconnected at their ends by transverse pivot rods 70B and 72B. These fit within horizontal guide slots 82B in guide bars 84B (FIGS. 4 and 5) which are fastened as by welding to the left hand side of the floor 36 of the housing 30.

The upper bar means (corresponding to 64 in FIGS. 9–14) includes a T-bar 46B interconnecting the left hand clamp posts 42, ears 90B and 92B at fore and aft edges of the clamp posts, plus the widths of the clamp posts 42 themselves.

The connecting link means (corresponding to 74 and 76 in FIGS. 9–14) comprise pairs of links 74B and 76B.

As shown in FIGS. 4 and 5, the lower ends of connecting links 74B are joined by a tube 71B which is transversely slideably journaled on the lower pivot rod 70B; likewise, the lower ends of connecting links 76B are joined by a tube 73B which is transversely slideably journaled on the lower pivot rod 72B. The upper ends of connecting links 74B are pivotally connected to the ends of pivot rod 66B supported by ear 90B; likewise, the upper ends of connecting links 76B pivotally connected to the ends of pivot rod 68B supported by ear 92B.

The transversely slideable journaled connection of the two links 74B with lower pivot rods 70B, and the transversely slideably journaled connection of the two links 76B with lower pivot rod 72B enables the left hand parallelogram linkage 60B to be shifted sideways to accommodate any variations in spacing between the two wheelchair frame tubes 26.

The right hand parallelogram linkage 60A is substantially identical to the left hand parallelogram linkage 60B just described, except that it is narrower, not needing any transverse adjustability. It will not be described in detail but the components comparable to linkage 60B are designated by the same reference numerals followed by "A" instead of "B".

The right and left hand parallelogram linkages 60A and 60B are interconnected by a transverse tie bar 100. As shown in FIG. 3, the tie bar is connected to the piston rod 58 by set screw 102, to right hand lower bar means 62A by set screws 104, and to left hand lower bar means 62B by set screws 106. Thus, extension or retraction of piston rod 58 shifts both lower bar means 62A and both lower bar means 62B simultaneously in the same direction, thereby simultaneously raising or lowering the clamp means 40.

Figure 8:
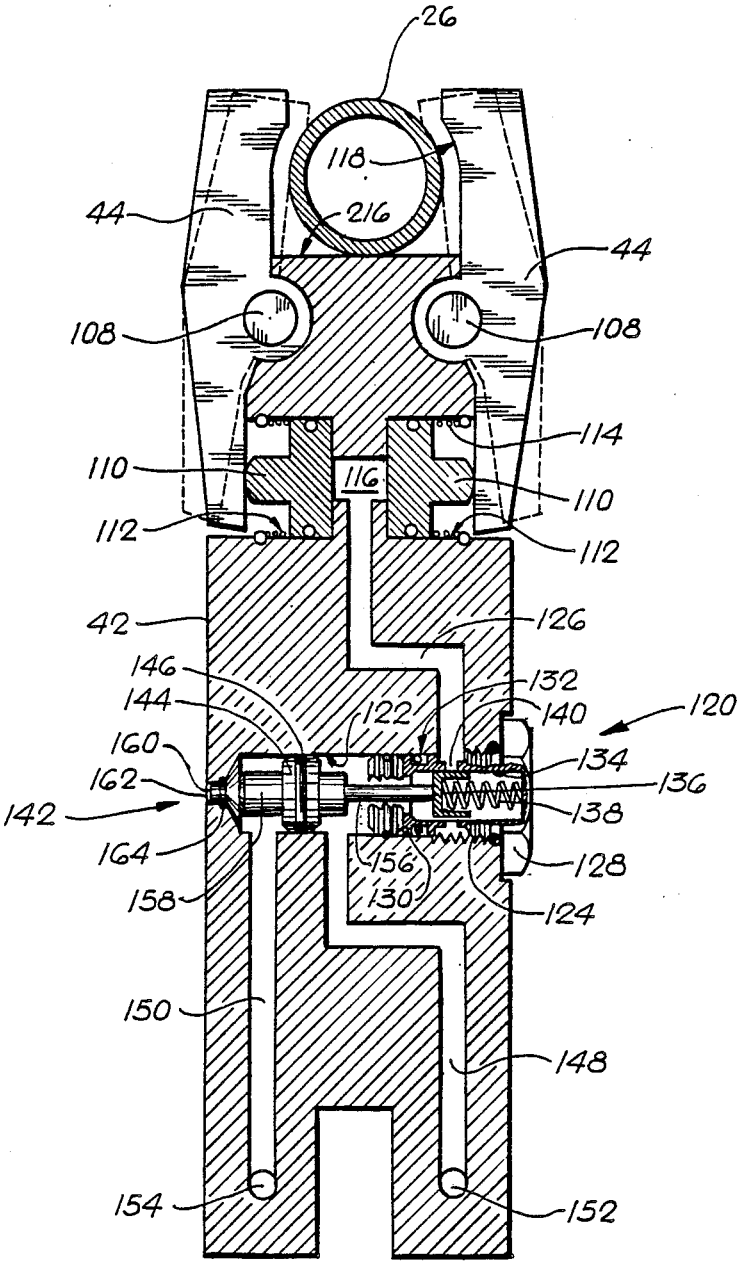
FIG. 8 is a vertical cross-sectional view of one of the clamp posts taken along line 8—8 in FIG. 6.

Referring to FIG. 8, the clamp jaws 44 are pivoted about pins 108 which may be press-fitted into the respective clamp post 42.

Second power means for simultaneously actuating all four pairs of clamp jaws 44 comprises four pairs of auxiliary pistons 110 in cylindrical bores 112 provided in the upper portions of the clamp posts. These auxiliary pistons are normally retracted by springs 114 and are extendible by pressure in intermediate chamber 116 to pivot the clamp jaws to the locked position shown in broken lines in FIG. 8. The jaws have concavities 118 to grip the frame tubes 26.

In the system illustrated, there are four pilot operated check valves 120, one in each clamp post as shown in FIG. 8 as will now be described.

A bore 122 is provided in each clamp post. A threaded counterbore 124 extends into bore 122 and intersects the passage 126 leading to chamber 116. A screw-threaded plug 128 is threadedly engaged with the counterbore and has an inner axial extension 130 with an O-ring seal 132 against bore 122. Plug 128 has an inner axial bore 134 with a spool 136 slideably engaged therein. A compression spring 138 normally holds the spool in the position shown in FIG. 8 blocking communication between the passage 126 and the bore 122. This holds the jaws 44 in the broken line locked position (FIG. 8) by blocking exit of fluid from passageway 126 through radial holes 140 in the plug 128. Manual override means generally designated 142 is provided for each pilot operated check valve 120. This comprises a spool 144 with an O-ring seal 146 located between passages 148 and 150 leading respectively from jaw clamp pressure passageway 152 and pilot valve release passageway 154. Spool 144 has inner and outer axial extensions 156 and 158 respectively engaging the spool 136 and a manually depressible button 160. The latter is located in an external bore 162 opposite the plug 128 and having a miniature O-ring seal 164.

In normal locking operation, fluid under pressure will enter the bore 122 through jaw clamp pressure passageway 152 and passageway 148. When the pressure is high enough in bore 122 to overcome spring 138, it will displace the spool 136 outwardly and fluid under pressure will pass through radial ports 140 and reach the chamber 116 via the counterbore 124 and passage 126. The pressure in chamber 116 will displace the pistons 110 simultaneously outwardly against the lower ends of the clamp jaw arms 44 rocking the clamp jaws to the locked position shown in broken lines in FIG. 8. If pressure in passageways 148, 152 and bore 122 is shut off or reduced, spring 138 displaces spool 136 to the left, to the position shown in FIG. 8, thereby closing off radial ports 140 and blocking the exit of fluid from the piston chamber 116. This holds the clamp jaws locked onto the frame tubes 26 as shown in broken lines in FIG. 8. If actuating pressure in the passageway 148 and bore 122 drops to zero, as during a trip, the jaws 44 will continue to be held locked by the fluid trapped under pressure in chamber 116.

The jaws 44 can be released from the frame tubes 26, as for example at the end of a trip, by simply pressurizing the portion of bore 122 beneath the spool 144, that is, at the left side of spool 144 in FIG. 8. This is done normally by pressurizing the end portion of bore 122 through a tube 228 and passageways 154 and 150. This displaces the spool 144 to the right (FIG. 8) causing its extension 156 to shift the spool 136 to uncover the radial ports 140. Pressure is then released from chamber 116 through a path including ports 140, that portion of bore 122 between spools 144 and 136, passageways 148 and 152, and line 220. When pressure zeroizes in chamber 116 in this way; the pistons 110 are retracted by springs 114 enabling the jaws 44 to be returned to their open position shown in solid lines in FIG. 8.

A power operation and control circuit means enables the wheelchair occupant, the driver of the vehicle, or an attendant remote from the wheelchair to lock the clamp means 40 onto the wheelchair frame, and subsequently to release it by a simple switch operation. This will now be described.

As best shown in FIGS. 3, 4, 5 and 9–14, this power operation and control circuit means comprises the first power means illustrated as the main cylinder and piston means 50; the second power means illustrated as the four pairs of clamp jaw pistons 110; an electric motor M; a pump P; a tank T; a solenoid operated four-way valve 166; sequence valves 168 and 170; a three-way toggle switch 171; and appropriate electrical conductors, and fluid tubular connections and passageways.

Figure 9:
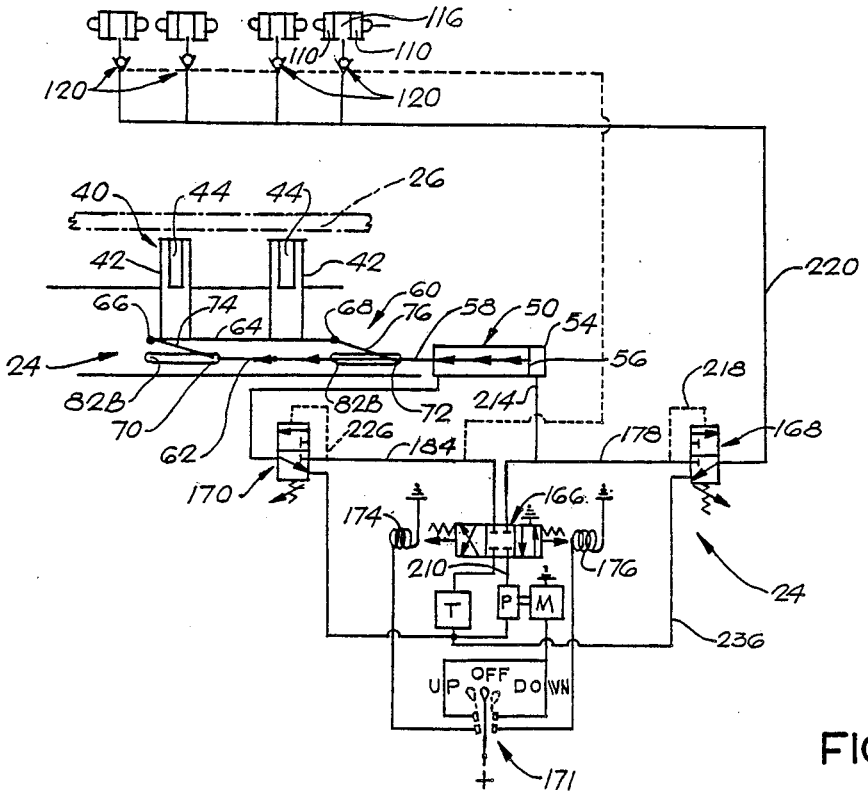
FIGS. 9–14 are schematic operating diagrams showing the apparatus in various operating modes making up a complete locking and releasing cycle.
Figure 13:
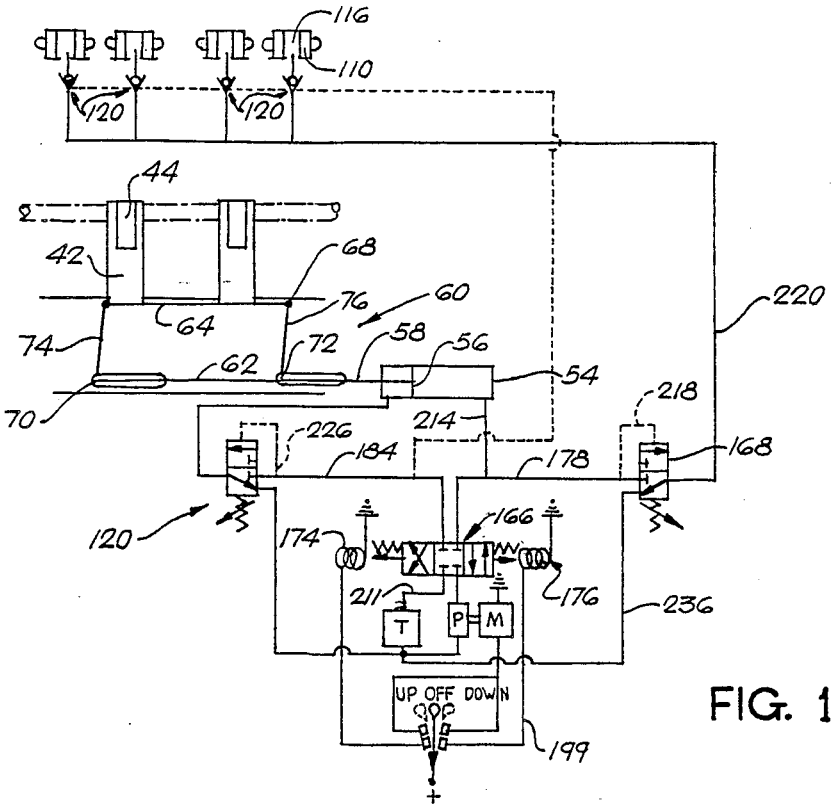

When the piston rod 58 is extended, it moves the cross-bar 100 (FIGS. 4 and 5) rearwardly and shifts lower slide bar means 62 (consisting of lower bar means 62A and 62B) simultaneously to the rear causing the parallelogram linkages to lift the clamp posts 42 from the FIG. 4 and 9, (retracted) positions to or toward the FIG. 5 and 13 (extended) positions.

The clamp jaw pistons 110 are displaced outwardly to move the clamp jaws 44 to the broken line, clamped positions shown in FIG. 8 when pressure in chamber 116 overcomes the retracting springs 114.

Figure 3A:
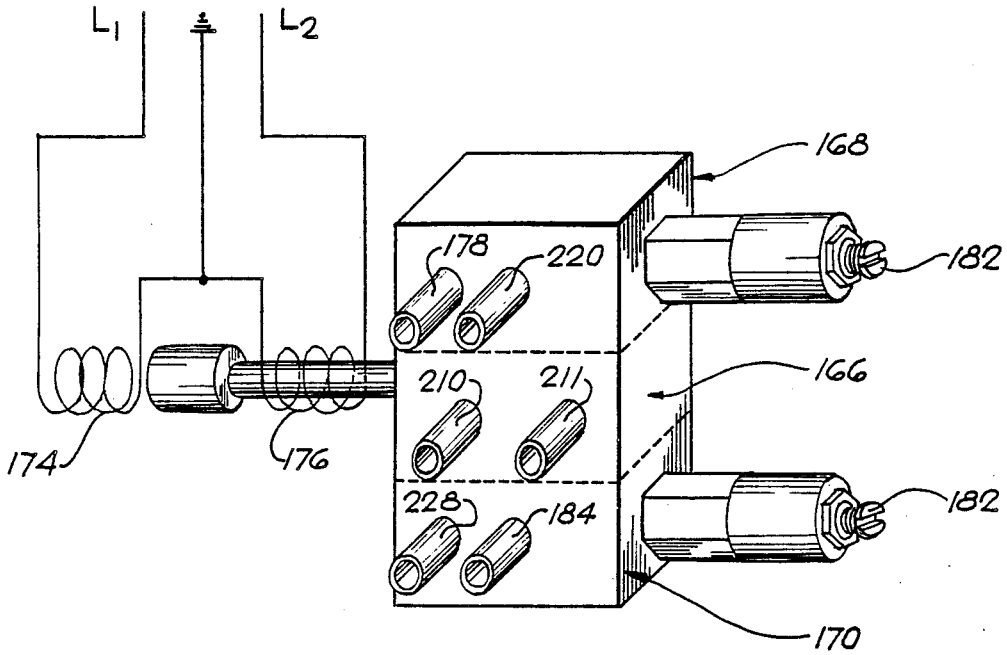
FIG. 3A is an enlarged, partly schematic, partly perspective view of a sequence valve and solenoid-operated four-way valve component as seen in the direction of lines 3A—3A in FIG. 3.

The solenoid operated four-way valve 166 and the sequence valves 168 and 170 are combined in a single manifold housing 172 best shown in FIG. 3A. These are schematically shown in FIGS. 9–14. When solenoid 174 is energized, the four-way valve 166 is in the position shown in FIG. 10; when solenoid 176 is energized, the four-way valve is in the position shown in FIG. 14; when neither is energized, the valve is in the centered, off position shown in FIGS. 9 and 13.

Sequence valve 168 is located in supply line 178 connecting the four-way valve 166 to the four pairs of clamp jaw pistons 110,110. It operates automatically in response to engagement of the clamp posts 42 with the underside of frame tube members 26. When the head end of main elevating piston 56 is pressurized, the lower slide bar means 62 is shifted rearwardly and causes the parallelogram linkage mechanism 60 to lift the clamp posts 42. When they engage the underside of the frame tubes 26, the increased back pressure in lines 178 and 218 shifts the sequence valve 168 to the position shown in FIG. 11. This supplies the clamp jaw pistons 110,110 with fluid under pressure through line 220 and locks the clamp jaws onto the frame tubes as shown in broken lines in FIG. 8. The particular weight of the wheelchair and occupant required to shift the sequence valve in this manner may be varied by adjustment screw 182, in the usual fashion.

The other sequence valve 170 is located in supply line 184 which connects the four-way valve 166 to the rod end of the main elevating piston 56 via sequence valve 170. It automatically determines the sequence in which the pilot operated check valves 120 are opened to unlock the clamp jaws 44. Preferably but not necessarily the check valves are opened before the rod end of the main piston 56 is pressurized to lower the clamp posts. The adjustment screw 182 (FIG. 3A) on sequence valve 170 may be similar to that on sequence valve 168 and determines the pressure in line 184 necessary to shift sequence valve 170 to the mode shown in FIG. 14. This controls the sequence of operation of opening the pilot-operated check valves and lowering the clamp posts.

Figure 7:
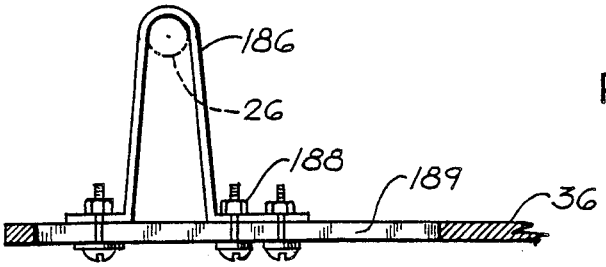
FIG. 7 is a fragmentary, enlarged, cross-sectional view of FIG. 2 taken along lines 7—7.
Figure 7A:
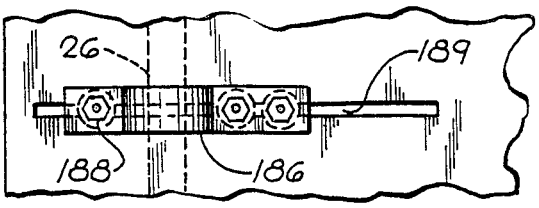
FIG. 7A is a top plan view of FIG. 7.

As an extra safety precaution which is entirely optional and not necessary for the safe and dependable operation of the present invention, a pair of inverted, U-shaped metal loops 186 may be fastened by means of bolts 188 to the cover plate 36 immediately to the rear of the rearward most clamp post 42 on each side. As shown in FIGS. 2 and 7 these loops will receive the rear ends of frame tubes 26. As shown in FIGS. 2A, 4 and 5, bolts 188 will extend through elongated slots 189 in the cover plate to provide transverse adjustability for the spacing between the loops 186 to match the transverse spacing between the clamp posts 42.

The three-way toggle switch 171 is shown only diagrammatically and in FIGS. 9-14. As illustrated, it comprises a manually movable armature 190 connected to a plus terminal of a suitable electrical power source. In the "UP" mode (FIGS. 10-12) it energizes pump motor M and solenoid 174 through contacts 192 and 194 respectively. In the "DOWN" mode (FIG. 14) it energizes pump motor M and solenoid 176 through contacts 196 and 198 respectively. In the "OFF" mode (FIGS. 9 and 13) the pump motor and both solenoids are de-energized.

Use and operation of the securement apparatus 24 will now be described.

FIGS. 4 and 9 show the securement apparatus when the motor and pump are turned off and the clamp posts are retracted their maximum into the housing.

As a first step, the wheelchair will be moved into the vehicle and the frame tubes 26 will be aligned with the clamp posts 42 over the housing 30. In this fully retracted position the clamp posts clear the wheelchair underframe. If the optional inverted U-shaped loops 186 are used, the rear ends of the frame tubes 26 will be inserted in them as shown in FIGS. 2A and 7.

Figure 10:
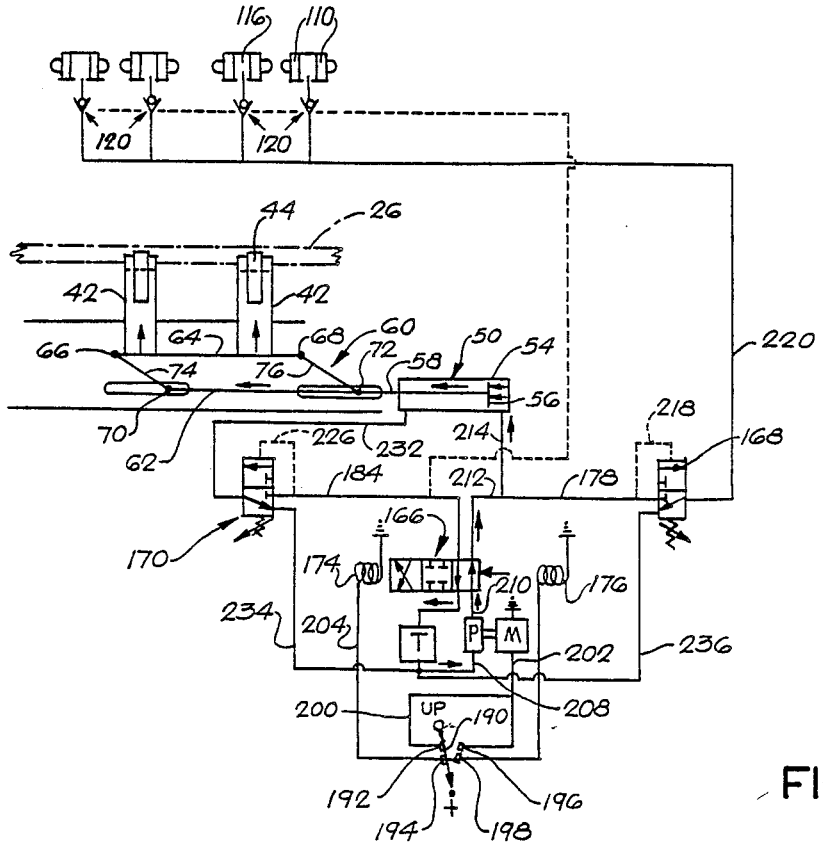

After verifying that the wheelchair is properly positioned, the occupant, or driver or attendant moves toggle switch 171 to the "UP" position (FIG. 10). This energizes motor M through contact 192 and conductors 200 and 202, and simultaneously energizes the left hand solenoid 174 through contact 194 and conductor 204. The solenoid pulls the spool of the four-way valve 166 to the left as shown in FIG. 10. Motor M drives pump P which draws hydraulic fluid from tank T through line 208 and pressurizes the head end of main piston 56 through lines 210, 212 and 214. Fluid returns from the rod end to tank through lines 232, sequence valve 170 and line 234. Referring to FIGS. 3 and 4, this moves cross bar 100 and lower bar means 62A and 62B to the left. The equivalent lower bar means 62 (FIG. 10) likewise moves to the left and lifts the clamp posts 42 toward the frame tubes 26.

Figure 11:
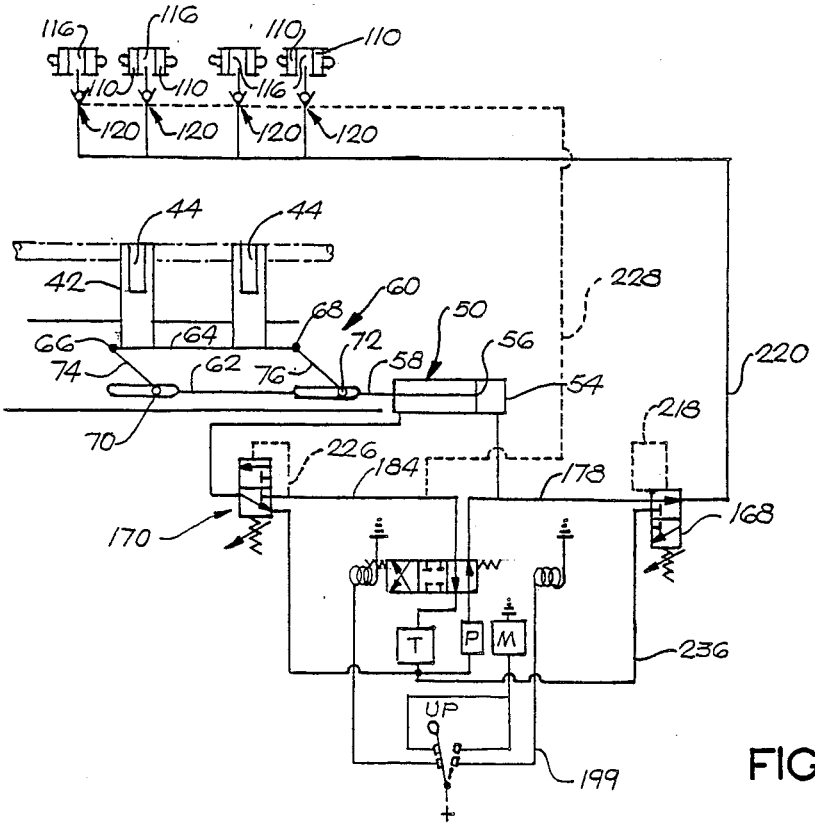

When the clamp posts 42 rise to the position shown in FIGS. 8 and 11, the frame members 26 will be fully received between the clamp jaws 44 with the upper clamp post surfaces 216 (FIG. 8) engaging the undersides of the frame tubes 26.

At this time, back pressure at the head end of main piston 56 will begin to rise as the clamp posts acquire the weight of the wheelchair and occupant. This rise in back pressure appears in line 178 and in sequence valve operating line 218, and shifts sequence valve 168 from its FIG. 10 to its FIG. 11 position. Pressure then flows through line 220, past pilot operated check valves 120 to chambers 116 between the clamp jaw pistons 110. (Referring to the clamp post cross section shown in FIG. 8, the pressure from line 220 is transmitted to all the clamp post passageways 152 and 148, shifts spool 136 sufficiently to open the radial ports 140 and thereby pressurizes all four clamp post chambers 116 through passageways 126. This shifts all four pairs of pistons 110,110 to clamp the corresponding jaws 44 onto respective portions of frame tubes 26 as shown in broken lines in FIG. 8.)

Figure 12:
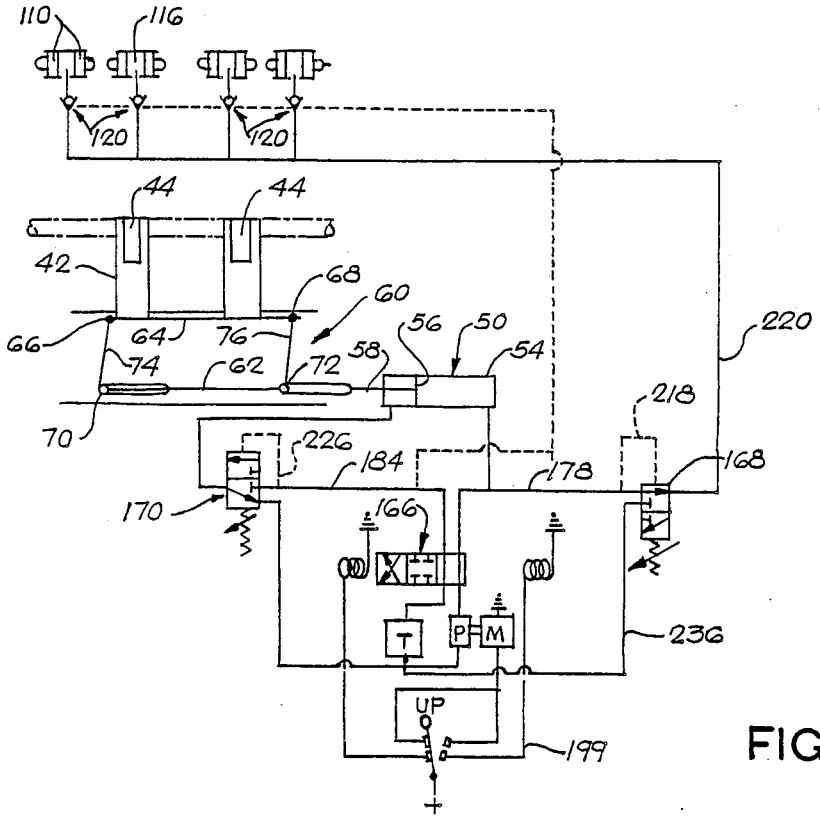

At this stage, the wheelchair is firmly secured with the wheels touching the floor. By moving the three-way toggle switch 171 to the center ("off") position, the occupant can be safely moved in the vehicle. Another option which is an important part of the present invention is that by continuing to hold the toggle switch 171 in the "UP" position, the clamp posts 42 continue to elevate until the main piston 56 reaches the end of its stroke as shown in FIGS. 2, 5 and 12. As shown in FIG. 2, the wheelchair wheels are now slightly elevated a distance "h" above the vehicle floor 32. Weight of the wheelchair and occupant is completely relieved from the wheels and the wheelchair is securely and completely supported by the clamp means alone.

To reach this position, the toggle switch 171 has been held in the "UP" position. The toggle switch handle is preferably self-centering, so when the operator releases it, the handle automatically returns to "OFF" shown in FIGS. 9 and 13. In this position, motor M stops and pump P ceases to operate for the duration of the trip. With the toggle switch "OFF", solenoid 174 is no longer energized and the spool of four-way valve 166 automatically returns to its centered position shown in FIG. 13; and with the pump off and lines 178 and 218 no longer pressurized, sequence valve 168 automatically returns to its initial position as is also shown in FIG. 13. Hydraulic block at both ends of line 178 (see FIG. 13 at valves 166 and 168) holds hydraulic fluid in the head end of main piston 56 thereby keeping the wheelchair elevated on the clamp posts 42. At the same time, hydraulic block at check valves 120 keeps the jaw pistons 110 extended and the clamp jaws locked onto the frame tubes as shown in broken lines in FIG. 8.

At the end of the trip, the occupant or other designated operator simply moves the toggle switch and holds it in the "DOWN" position until the clamps are released and the wheelchair lowered to the floor. The sequence in which this is accomplished will now be described.

Figure 14:
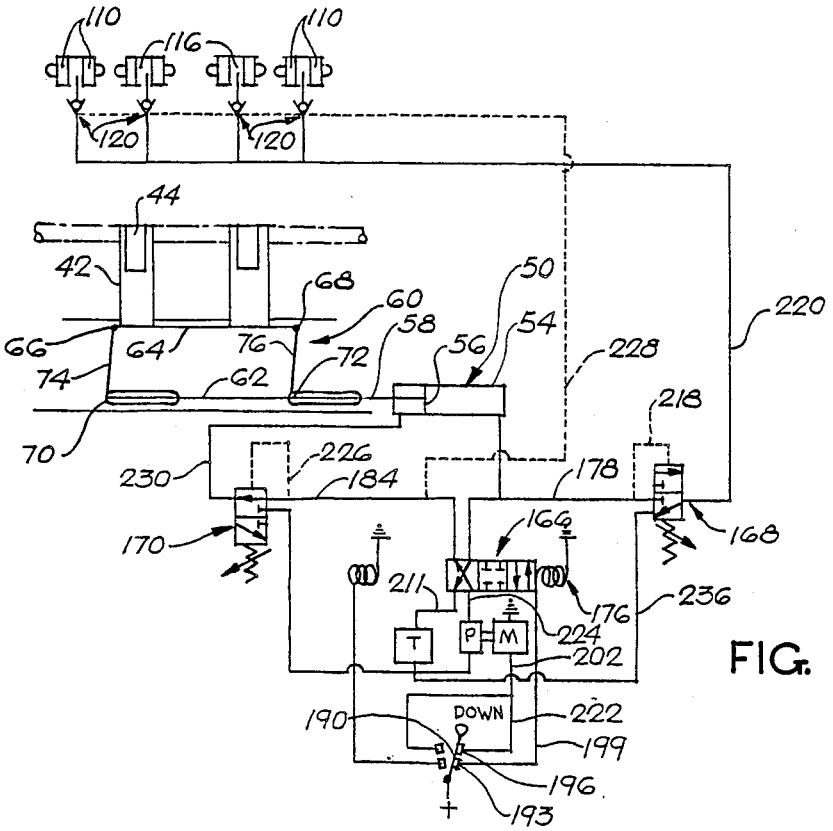

Referring to FIG. 14, the toggle switch in "DOWN" position energizes the pump drive motor M through contact 196 and lines 222 and 202, and energizes solenoid 176 through contact 198 to shift the spool of four-way valve 166 to the right. The pump draws hydraulic fluid from the tank T and pressurizes line 224 and 184, sequence valve operating line 226 and check valve pilot operating lines 228 simultaneously. Pressure from line 184 is transmitted through line 228 (and into clamp post passageways 154 — see FIG. 8) thereby opening all four check valves 120 at once. (Referring to FIG. 8, pressure in passageways 154 and 150 displaces spool 144 to the right thereby opening valve spool 136 enabling pressure to be released from chamber 116 through the radial ports 140.) Return fluid from the check valves passes to tank via passage 152 (FIG. 8) and lines 220, sequence valve 168, and tank return line 236.

Referring to FIGS. 3, 5 and 14, the pressure in lines 184 and 226 shifts sequence valve 170 downward (FIG. 14) and pressure passes through line 230 to the rod end of main piston 56 which then shifts to the right. This moves the piston rod 58 to the right, along with cross bar 100 (FIGS. 3 and 5), and lower slide bar means 62. This lowers the clamp posts 42 to their lower limit, to the out-of-the-way position shown in FIGS. 4 and 9 where the wheels 28 engage the floor 32 and the wheelchair is fully released and fully mobile again. The toggle switch armature is released to its "OFF" position returning the system to the beginning position shown in FIGS. 3 and 9.

Impact tests on an impact sled have been conducted successfully on prototypes of the present invention at the University of Michigan Transportation Research Institute.

The impact sled operates on the rebound principle, achieving a desired velocity by reversing its direction of motion during the impact event. The sled crash pulse is trapezoidal in shape and is reported as an average deceleration level in g's. The sled velocity is monitored immediately before and after impact. A 50th percentile dummy weighing 170 lbs was used to represent the size and weight of a typical wheelchair occupant. GSE seat belt load cells were used to measure webbing tensions in the restraint belts 21 and 23 (FIG. 2) and others where possible and appropriate.

Data generated during the test were multiplexed and recorded on the direct record channels of a Honeywell Model 96 magnetic tape recorder. The signals were subsequently demultiplexed and time-expanded for digitizing, filtering, and analysis on a NOVA/4 computer. All signals were filtered to the requirements of SAEJ-211.

Photo-instrumentation consisted of high-speed (1000 frame/sec) 16 mm motion picture cameras (Photosonics 1B) for side and overhead views of the impact event. A Polaroid graph-check camera was also used to provide a quick-look sequenced photograph of the impact event. The transducer data and the motion picture test films were simultaneously marked by a timing pulse generated at ten millisecond intervals. A strobe flash recorded the onset of impact.

In a typical impact test, the setup was as follows:

| | | |
|---|---|---|
| * | Test # | WA8902 |
| * | Test date | February 1, 1989 |
| * | Sponsor | Action Concepts |
| * | Wheelchair restraint | "Positive-Lock" System |
| * | Occupant restraint | Lap and shoulder belt |
| * | Wheelchair type | Everest and Jennings, Premier Electric Wheelchair |
| * | Test dummy | 50th percentile male |
| * | Orientation | Forward facing |
| * | Sled platform | Steel plate |
| * | Desired test velocity | 20.0 mph / V |
| * | Desired sled deceleration | 10.0 G's |
| * | Shoulder belt anchor points | |
| | Right side: | 14.5" below right wheel hub<br>13.0" behind right wheel hub<br>7.0" right of right wheel hub |
| | Left side: | 14.5" below left wheel hub<br>10" behind left wheel hub<br>0.0 left of left wheel hub |
| * | Shoulder belt D-loop anchor point | 34" above left wheel hub<br>10" behind left wheel hub<br>0.0" left of left wheel hub |
| * | Distance between tie-down attachment points on wheelchair | 6.5" front/back<br>14.5" side/side |

An Everest and Jennings power wheelchair frame with motors and simulated battery pack was used to approximate a standard electric wheelchair. The lower horizontal frame members 26 of the wheelchair frame were elevated and locked by the four hydraulically-actuated clamp jaws 44. A lap belt was tied to the wheelchair frame at the welded junctions of the seat-back and seat frame members and the shoulder belt was anchored to the sled platform, the upper portion first going through a D-ring that was bolted to a simulated vehicle structure. The sled pressures were set to achieve a velocity differential of 20 mph and a deceleration pulse of 10 G's which are considered to represent typical crash conditions for a large bus traveling in non-highway traffic conditions.

The test results were as follows:

| | | |
|---|---|---|
| * | Actual velocity differential | 20.5 mph change in velocity |
| * | Actual sled deceleration | 9.4 G's |
| * | Crash pulse duration | 103.5 msec |
| * | Peak force right lap belt | 828.3 lb |
| * | Peak force left lap belt | 797.6 lb |
| * | Peak force upper shoulder belt | 1259.9 lb |
| * | Peak force lower shoulder belt | 974.2 lb |
| * | Peak resultant chest acceleration | 26.8 G's |
| * | Peak resultant head acceleration | 26.6 G's |
| * | Head Injury Criteria | 128.0 |

The system secured the wheelchair in place during the impact allowing only 1.6 inches of forward movement during the test. After the test the wheelchair remained clamped in the four sets of hydraulic clamp jaws 44. The maximum head excursion was 11.1 inches, in the forward direction. The wheelchair frame experienced deformation of the lower rungs but the dummy was "safe".

While particular examples of the present invention have been shown and described, it is apparent that changes and modifications may be made therein without departing from the invention in its broadest aspects. The aim of the appended claim, therefore, is to cover all such changes and modifications as fall within the spirit and scope of the invention.

The embodiments of the invention in which an exclusive property of privilege is claimed are defined as follows:

1. Apparatus for securing a wheelchair to the floor of a vehicle comprising:

a housing having means for fixing it to the floor of the vehicle;

clamp means comprising a plurality of vertically moveable post means having upwardly open jaw means and being supported by said housing for movement between raised and lowered positions;

power means for raising and lowering said post means and for locking and unlocking said jaw means; and control means for said power means including means selectively operable to move said post means between a lowered position with the jaw means unlocked and a raised position with the jaw means locked.

2. Apparatus for securing a wheelchair according to claim 1 in which the control means includes means automatically actuating the power means to lock the jaw means in response to predetermined resistance to raising movement of the post means.

3. Apparatus for securing a wheelchair according to claim 1 in which said power means includes a main piston means operatively connected to said clamp means, means for applying lifting pressure to said main piston means to raise said post means, and means responsive to a predetermined increase in said lifting pressure for actuating said power means to lock said jaw means.

4. Apparatus for securing a wheelchair according to claim 1 in which said clamp means is adapted to lock onto an underframe portion of the wheelchair; and said control means includes means automatically actuating the power means to lock the jaw means onto the underframe portion in response to raising effort applied by the power means to the underframe portion.

5. Apparatus for securing a wheelchair to the floor of a vehicle comprising:

a housing having means for fixing it to the floor of the vehicle;

clamp means comprising a plurality of vertically moveable post means having upwardly open jaw means and being engageable with the under frame of the wheel chair and being supported for up and down movement between raised and lowered positions relative to the housing;

power means for raising and lowering said post means and for locking and unlocking said jaw means;

control means for said power means including means selectively operable to move said post means between a lowered position with the jaw means unlocked from the underframe and a raised position with the jaw means locked to the underframe.

6. Apparatus for securing a wheelchair according to claim 5 in which the control means includes means for locking said jaw means onto the underframe in response to engagement of the clamp means with the underframe during upward movement.

7. Apparatus for securing a wheelchair according to claim 5 in which the control means includes means for unlocking said jaw means from the underframe during downward movement of the clamp means.

8. Apparatus for securing a wheelchair according to claim 5 in which the control means includes means for unlocking said jaw means from the underframe in response to the beginning of downward movement of the clamp means.

9. Apparatus for securing a wheelchair according to claim 5 in which the control means includes means for optionally locking said jaw means onto the underframe.

10. Apparatus for securing a wheelchair according to claim 5 in which the control means includes means for locking the jaw means onto the underframe with the wheels optionally engaged with or disengaged from the floor.

11. Apparatus for securing a wheelchair to the floor of a vehicle comprising:

a housing;

clamp means supported by the housing for up and down movement;

first power means for raising and lowering said clamp means;

second power means for locking said clamp means onto the underframe of the wheelchair;

control means for said power means including means for actuating said first power means to raise said clamp means into engagement with the underframe, means for actuating said second power means to lock said clamp means onto the underframe, means for deactuating said second power means to unlock said clamp means from the underframe, and means for actuating said first power means to lower said clamp means to a stowed, out-of-the-way position beneath the wheelchair underframe.

12. Apparatus for securing a wheelchair to the floor of a vehicle according to claim 11 in which the control means includes means for automatically actuating said second power means to lock said clamp means onto the underframe in response to engagement of the clamp posts with the underside of the underframe while the clamp means are being raised by the first power means.

13. Apparatus for securing a wheelchair to the floor of a vehicle comprising:

a housing adapted to be secured to the floor beneath the underframe of the wheelchair and between the wheels therefore;

a plurality of clamp posts supported on said housing for up and down movement between a lower, stowed position clear of the underframe and an upper position engaging the underframe;

first power means for raising and lowering said clamp posts;

a pair of clamp jaws supported on each post and being movable between locked and unlocked positions;

second power means for moving said clamp jaws to locked positions;

control means for said first and second power means including means for actuating said first power means to raise said clamp posts into engagement with the underframe, means for actuating said second power means to lock said clamp jaws onto said underframe, means for deactuating said second power means to unlock said clamp jaws from the underframe, and means for actuating said first power means to lower said clamp posts to said stowed position.

14. Apparatus for securing a wheelchair according to claim 13 in which the control means includes means for automatically actuating said second power means to move said clamp jaws to locked position in response to engagement of the clamp posts with the underside of said underframe while the clamp posts are being raised by said first power means.

15. Apparatus for securing a wheelchair according to claim 13 in which said second power means is carried by and movable with said clamp posts.

16. Apparatus for securing a wheelchair to the floor of a vehicle comprising:

a housing adapted to be secured to the vehicle floor beneath the underframe thereof;

a plurality of clamp posts supported o said housing for up and down movement between a lower, stowed position clear of the underframe and an upper, secured position engaging the underframe;

main pressure-operated power means having alternative pressure inlet ports, operatively connected to the clamp posts for alternatively raising and lowering same;

each clamp post having at least one clamp jaw engagable with the underframe, and at least one pressure-operated clamp jaw power means operatively connected with the clamp jaw and adapted to engage the underframe;

a four-way valve having an inlet port connectible to a source of fluid under pressure, and having first and second outlet ports, said four-way valve being actuatable to direct fluid under pressure optionally through said first or second outlet port; and means for elevating the clamp posts and locking the clamp jaws including first conduit means connecting the first outlet port with one end of the main pressure-operated power means, a first sequence valve connected to said first conduit means and effective in response to a predetermined pressure therein to direct fluid under pressure to the clamp jaw power means for locking the clamp jaws onto the underframe, and check valve means between the first sequence valve and the clamp jaw power means to hold pressure therein and keep the clamp jaws locked; and means for lowering the clamp posts and unlocking the clamp jaws including pressure-responsive releasing means for releasing fluid pressure from between the check valve means and the clamp jaw power means, second conduit means connecting the second outlet port to said pressure-responsive releasing means and to a second sequence control valve which is effective in response to a predetermined pressure in said second conduit means to direct fluid under pressure to the other end of the main pressure-operated power means.

17. Apparatus for securing a wheelchair according to claim 16 in which said check valve means is a pilot-operated check valve and said pressure-responsive releasing means enables two-way flow through the check valve means when said second conduit means is pressurized through the second outlet port of the four-way valve.

18. Apparatus for securing a wheelchair according to claim 17 in which the check valve means comprises a separate pilot-operated check valve at the inlet to the pressure-operated clamp jaw power means in each clamp post.

19. Apparatus for securing a wheelchair according to claim 16 in which the main pressure-operated power means and the pressure-operated clamp jaw power means are piston and cylinder means.

20. Apparatus for securing a wheelchair according to claim 16 in which the first sequence control valve is adjustable to respond to different pressure conditions in the first conduit means.

21. Apparatus for securing a wheelchair according to claim 16 in which the second sequence control valve is adjustable to respond to different pressure conditions in the second conduit means.

22. Apparatus for securing a wheelchair according to claim 16 in which the main pressure-operated power means responds to a lower pressure in the first conduit means than the first sequence valve enabling the pressure in the first conduit means to actuate the main pressure-operated power means before it causes the first sequence valve to direct fluid under pressure to the clamp jaw power means.

23. Apparatus for securing a wheelchair according to claim 16 in which the pressure-responsive releasing means responds to a lower pressure in the second conduit means than the second sequence control valve enabling the pressure in the second conduit means to activate the releasing means and unlock the clamp jaws before it causes the second sequence valve to direct fluid under pressure to the other end of the main pressure-operated power means and begin lowering the clamp posts.

24. Apparatus for securing a wheelchair to the floor of a vehicle comprising:

a housing;

clamp means supported by the housing for up and down movement;

main piston means for raising and lowering said clamp means; auxiliary piston means for locking said clamp means;

valve means having an inlet port connectible to a source of fluid under pressure and having two outlet ports one of which is connected to one end of the main piston means;

a sequence valve connected to one of said outlet ports and effective in response to a predetermined pressure in said one outlet port to direct fluid under pressure from said one outlet port to said auxiliary piston means;

another sequence valve connected to the other of said outlet ports and effective in response to a predetermined pressure in said other outlet port to direct fluid under pressure from said other outlet port to the other end of said main piston means; and control means for optionally placing said valve means in one mode directing fluid under pressure to said one outlet port, or in another ode directing fluid under pressure to said other outlet port.

25. Apparatus for securing a wheelchair according to claim 24 including:

check valve means preventing backflow from said auxiliary piston means;

means for enabling backflow from said auxiliary piston means; and means connecting said other outlet port to said means for enabling backflow from said auxiliary piston means to thereby release pressure from said auxiliary piston means in response to pressure in said other outlet port.

26. Apparatus for securing a wheel chair according to claim 25 in which said check valve means is pilot operated, and said means for enabling backflow from said auxiliary piston means is pilot means actuatable in response to pressure in said other outlet port.

27. Apparatus for securing a wheelchair to the floor of a vehicle comprising:

a housing adapted to be secured to the vehicle floor beneath the underframe thereof;

A plurality of clamp posts supported on said housing for up and down movement between a lower, stowed position clear of the underframe and an upper, secured position engaging the underframe;

an elevating piston operatively connected to said clamp posts for raising and lowering same;

each clamp post having at least one clamp jaw engagable with the underframe, at least one clamp jaw piston operatively connected with the clamp jaw, and a pilot-operated check valve enabling one-way flow of fluid to the clamp jaw piston and being actuatable to enable release of fluid therefrom;

a four-way valve having an inlet port connectible to a source of fluid under pressure and having first and second outlet ports;

said four-way valve being optionally actuatable in "UP" or "DOWN" modes to direct fluid under pressure to the first or second outlet port respectively;

conduit means for connecting the first outlet port to one end of the elevating piston for raising said clamp posts;

a first sequence valve connected by conduit means to said first outlet port and effective in the "UP" mode in response to a rise in pressure in the first outlet port following engagement of the clamp posts with the underframe, to thereby direct fluid under pressure from said first outlet port to said clamp jaw pistons for locking the clamp jaws onto the underframe;

a second sequence valve connected by conduit means to said second outlet port and effective in the "DOWN" mode in response to a rise in pressure in the second outlet port, following actuation of said pilot-operated check valves to release fluid from the clamp jaw pistons, to thereby direct fluid under pressure from said second outlet port to the other end of the elevating piston for lowering said clamp posts; and control means for optionally placing said four-way valve in "UP" mode to raise the clamp posts from the lowered, stowed positions and lock the clamp jaws on the underframe, or in "DOWN" mode to unlock the clamp jaws and lower the clamp posts from the upper secured positions.

28. Apparatus for securing a wheelchair according to claim 27 in which said control means in "UP" mode is capable of raising the wheelchair with its wheels disengaged from the floor and with the clamp posts and clamp jaws furnishing the sole support.

* * * * *

UNITED STATES PATENT AND TRADEMARK OFFICE

CERTIFICATE OF CORRECTION

PATENT NO. : 4,973,022

DATED : 11/27/90

INVENTOR(S) : Thomas L. Mayland

It is certified that error appears in the above-identified patent and that said Letters Patent is hereby corrected as shown below:

Column 12, line 45, "o" should be - on -.

Column 14, line 17, "ode" should be - mode -.

Signed and Sealed this

Seventeenth Day of March, 1992

*Attest:*

HARRY F. MANBECK, JR.

*Attesting Officer*

*Commissioner of Patents and Trademarks*